US006419151B1

(12) United States Patent
Urtubey

(10) Patent No.: US 6,419,151 B1
(45) Date of Patent: Jul. 16, 2002

(54) PACKAGE WITH INTEGRAL RETRACTILE POURING SPOUT

(76) Inventor: Martin Gabriel Urtubey, Freire 2742, C1428CZP, Capital Federal-Buenos Aires (AR)

( * ) Notice: Subject to any disclaimer, the term of this patent is extended or adjusted under 35 U.S.C. 154(b) by 0 days.

(21) Appl. No.: 09/985,405

(22) Filed: Nov. 2, 2001

(30) Foreign Application Priority Data

Nov. 3, 2000 (AR) ..... P00 01 05794

(51) Int. Cl.[7] ..... B65D 17/78; B65D 5/74
(52) U.S. Cl. ..... 229/215; 229/125.42
(58) Field of Search ..... 229/215, 217, 229/219, 125.42

(56) References Cited

U.S. PATENT DOCUMENTS 3,002,673 A * 10/1961 Asman ..... 229/219
3,133,688 A * 5/1964 Asman ..... 229/215
3,289,913 A * 12/1966 Svensson ..... 229/217
3,306,514 A * 2/1967 MacKendrick ..... 229/219
4,657,174 A * 4/1987 Henning ..... 229/215
4,921,104 A * 5/1990 Holmes ..... 229/217
4,953,781 A * 9/1990 Bryan ..... 229/125.42
5,531,376 A * 7/1996 Brink et al. ..... 229/215
5,810,250 A * 9/1998 Stone et al. ..... 229/215
6,145,736 A * 11/2000 Ours et al. ..... 229/125.04

* cited by examiner

*Primary Examiner*—Gary E. Elkins
(74) *Attorney, Agent, or Firm*—Michael D. Bednarek; Shaw Pittman LLP

(57) ABSTRACT

A package for pourable products, with integral tamper-evident retractile pouring spout and pouring control, the package comprising a box with a corner thereof having a pouring opening defined between an upper wall, a front wall and side walls, the corner including an upper inclined portion downwardly extending from the upper wall towards the front wall, and a snapping movable portion upwardly extending the front wall and overlapping the upper inclined portion, the snapping portion snap-moving between a close position wherein the snapping portion is resting against the upper inclined portion and closing the opening, and an open position wherein the snapping portion is spaced apart from the upper inclined portion in a manner that the pouring opening forms a pouring spout.

20 Claims, 4 Drawing Sheets

PACKAGE WITH INTEGRAL RETRACTILE POURING SPOUT

BACKGROUND OF THE INVENTION

1. Field of the Invention

The present invention relates to a package having an unfolding and deploying spout for containing, pouring and dispensing products that are capable of flowing or pouring, namely pourable products, and more particularly the invention refers to a package preferably comprised of a package comprising a box having side walls, a bottom or lower wall, an upper or top wall, a front wall and a rear wall, wherein the spout is defined at a vertex or corner of the box with the corner being defined by the upper wall, the front wall and the side walls. Preferably, the side walls are parallel to each other, the front and rear walls are also parallel and the upper and lower walls are parallel to each other too, with the pouring spout being integral with the remaining of the package and the package being preferably made from an integral, only one piece, of laminar material, such as a cardboard. The spout being a pivoting retractile spout moving between a closing position and an opening position.

For the purpose of the present application the term "pourable" must be understood as encompassing any product capable of flowing or pouring such as a powder, powdered products, pellets, grains, particles, all preferably dry products, such as powdered soap, rice, salt, beans and the like. Even some wet products may be considered within this term as long as the package, particularly the spout of the invention, is manufactured or provided with materials capable of resisting the wet conditions of the product contained in the inventive package.

2. Description of the Prior Art

It is well known to provide several types of packages for pourable or flowable products such as powder or grains, pellets, some food products such as powder milk, coffee, cereals, spices, etc., among other products. Most of these packages are quadrangular sealed boxes having a corner thereof with weaken lines or indications for making a cut by means of a scissors or any other cutting element to make an opening for pouring the product contained in the box. Some of the box walls around this opening may be also collapsed in order to form the same into a channel for facilitating the pouring of the product. When pre-cut lines or weakened lines are provided no cutting elements may be necessary and the opening may be provided by pushing a portion of the box inwardly and breaking the corresponding wall to define the necessary opening.

While the above described packages have been widely used one of the drawbacks thereof is that, once the opening or spout is formed by cutting the box material, the package can not be properly re-closed or re-sealed what renders the package unuseful. With the package not properly closed and sealed the product may spill out the box as well as the product may be exposed to particles and dirty entering through the open spout, even humidity, all of which can negatively affect the product contained in the box. This is particularly undesirable when the product contained in the box is a food product.

Another similar packages include, close to a corner designed for pouring or supplying the product, a metal fitting fixed by any means to a front wall of the box, the fitting essentially consisting of a retractile cap-spout that is connected through a hinge, at a bottom part of the fitting, to the box, with the fitting being initially closed and sealed against the front wall by means of an adhesive tape for preventing the pilfering or tampering of the box, which tape must be removed at the time of using the product. However, this kind of packages and closure arrangements do not overcome entirely the drawbacks of the previously described packages. Since the adhesive tape can not support further adhesive retention once removed, the pivoting fitting do not have any additional means for retaining the same in the closing position against the box. In addition to the foregoing, the materials and the equipment involved in the manufacturing of this package, as well as the necessary manufacturing steps for forming the cap-spout and for mounting the same in the box, result in a final product that is expensive, with a non competitive price.

The present inventor has also designed a package with retractile integral spout capable of moving from a close position to an open position, however the spout structure included several tearing portions that would have been excessively exposed to the tampering action of consumers in a store, with those portions not complying with the tampering safety requirements. This would have caused the product to be removed from the store shelf and discarded. In addition, the spout structure, basically comprising a snapping spout, did not guarantee a reliable sealing or closing of the package after the opening of the spout.

It would be therefore convenient to have a new package capable of containing pourable products, the package being an easy-to-manufacture, cost effective box with a pouring spout integral with the package and capable of being opened and re-sealed in order to keep the unused product in good storing conditions.

SUMMARY OF THE INVENTION

It is therefore one object of the present invention to provide a package for pourable products, with tamperevident retractile pouring spout, the package comprising a box with a corner thereof having a pouring opening defined between an upper wall, a front wall and side walls, the corner including an upper inclined portion downwardly extending from the upper wall towards the front wall, and a snapping movable portion upwardly extending from the front wall and overlapping the upper inclined portion, the snapping portion snap-moving between a close position wherein the snapping portion is resting against the upper inclined portion and closing the opening, and an open position wherein the snapping portion is spaced apart from the upper inclined portion in a manner that, together with the pouring opening, forms a pouring spout.

It is still another object of the present invention to provide a package, with integral tamper-evident retractile pouring spout and pouring control, for containing and dispensing pourable products, the package comprising a box made from an integral cardboard piece, the box having at least one corner formed by side walls, an upper wall and a front wall, the corner including an upper inclined portion downwardly extending from a transverse folding line in the upper wall towards the front wall, a snapping movable portion in the front wall, the snapping portion upwardly extending from a folding line in the front wall towards the upper inclined portion, and a pouring opening defined between the upper inclined portion and the snapping movable portion, wherein the snapping portion is movable between a close position wherein the snapping portion is resting against the upper inclined portion and closing the opening, and an open position wherein the snapping portion is spaced apart from the upper inclined portion in a manner that the pouring opening forms, together with the snapping portion, a pouring spout, the snapping portion being connected to the side walls by resilient driving means for providing the snapping portion with a snapping effect in the movement between the close position and the open position.

It is a further object of the present invention to provide a package that may be manufactured from a single blank laminar piece by means of simple, rapid and cost effective process, with the package including a retractile spout integral to the package and capable of being easily handled by the consumer for providing an efficient pouring or dispensing function.

It is even another object of the present invention to provide a package with a deploying retractile pouring spout all conformed by only one piece of laminar material, such as cardboard, the package and spout being designed for containing and dispensing powder or pellets.

It is a further object of the present invention to provide a package having a tamper-evident and pilfer-proof pouring spout that does not need of any cutting element to be opened and, once opened, can be re-closed re-sealed to prevent the product contained in the package from spilling out or pouring out the package.

The above and other objects, features and advantages of this invention will be better understood when taken in connection with the accompanying drawings and description.

BRIEF DESCRIPTION OF THE DRAWINGS

The present invention is illustrated by way of example in the following drawings wherein.

DESCRIPTION OF THE PREFERRED EMBODIMENTS

Figure 1:
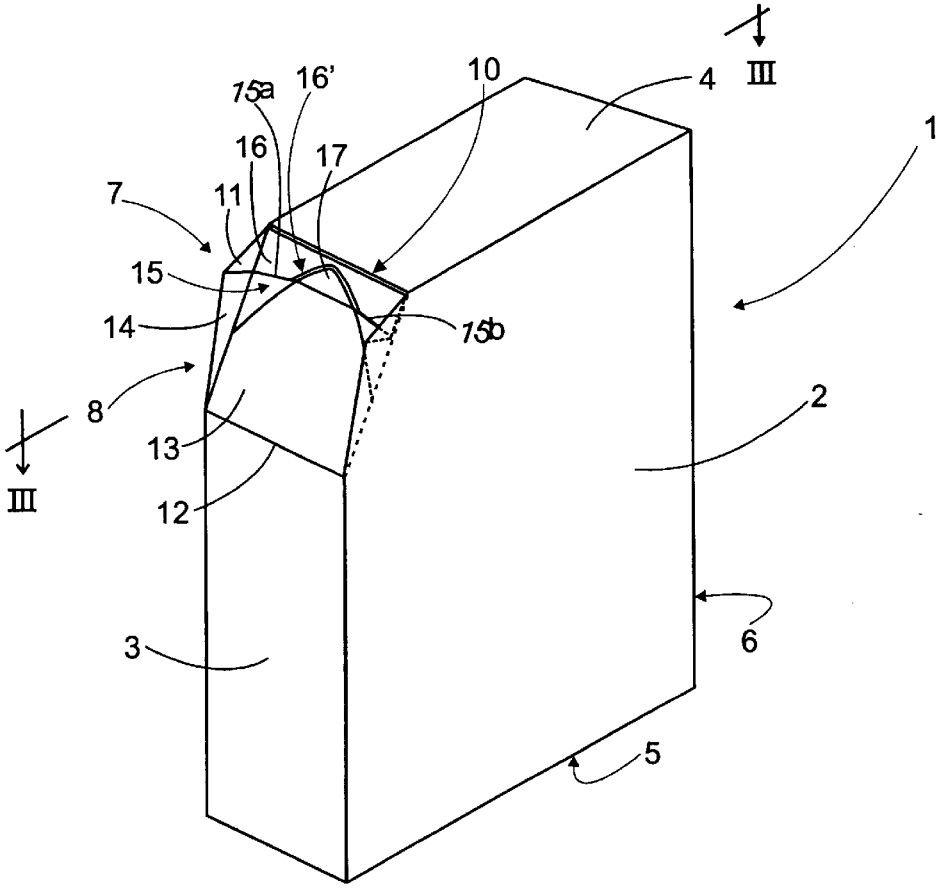
FIG. 1 shows a top side perspective view of a package according to the invention, the package having the deploying snapping portion adhered to the upper inclined portion, in a closed position, thus, the package being shown in a condition before being opened by a consumer.
Figure 2:
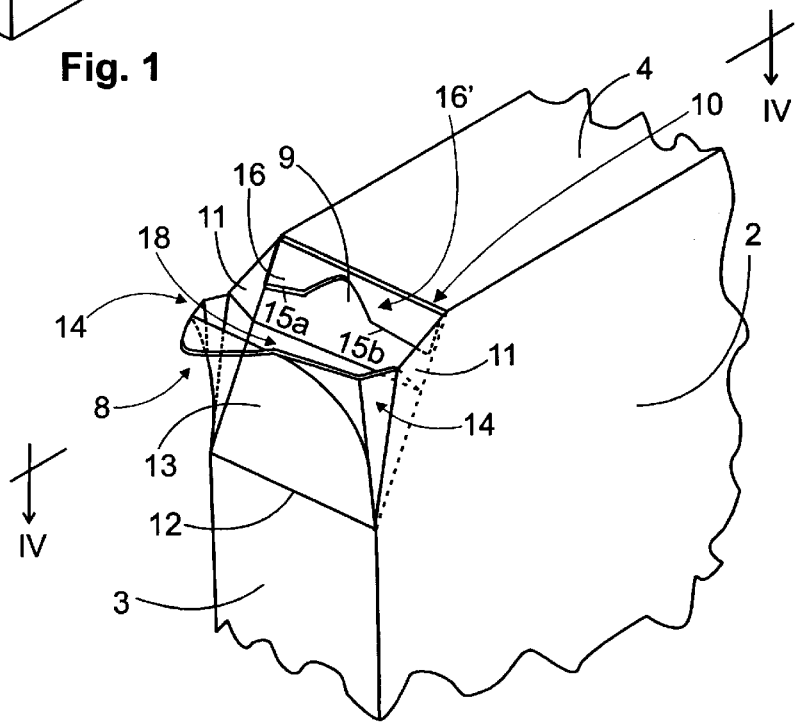
FIG. 2 shows a partial top side perspective view of the corner of the package of FIG. 1 showing the snapping portion in the open or deployed position, with the inventive package forming a pouring spout according to the invention.
Figure 5:
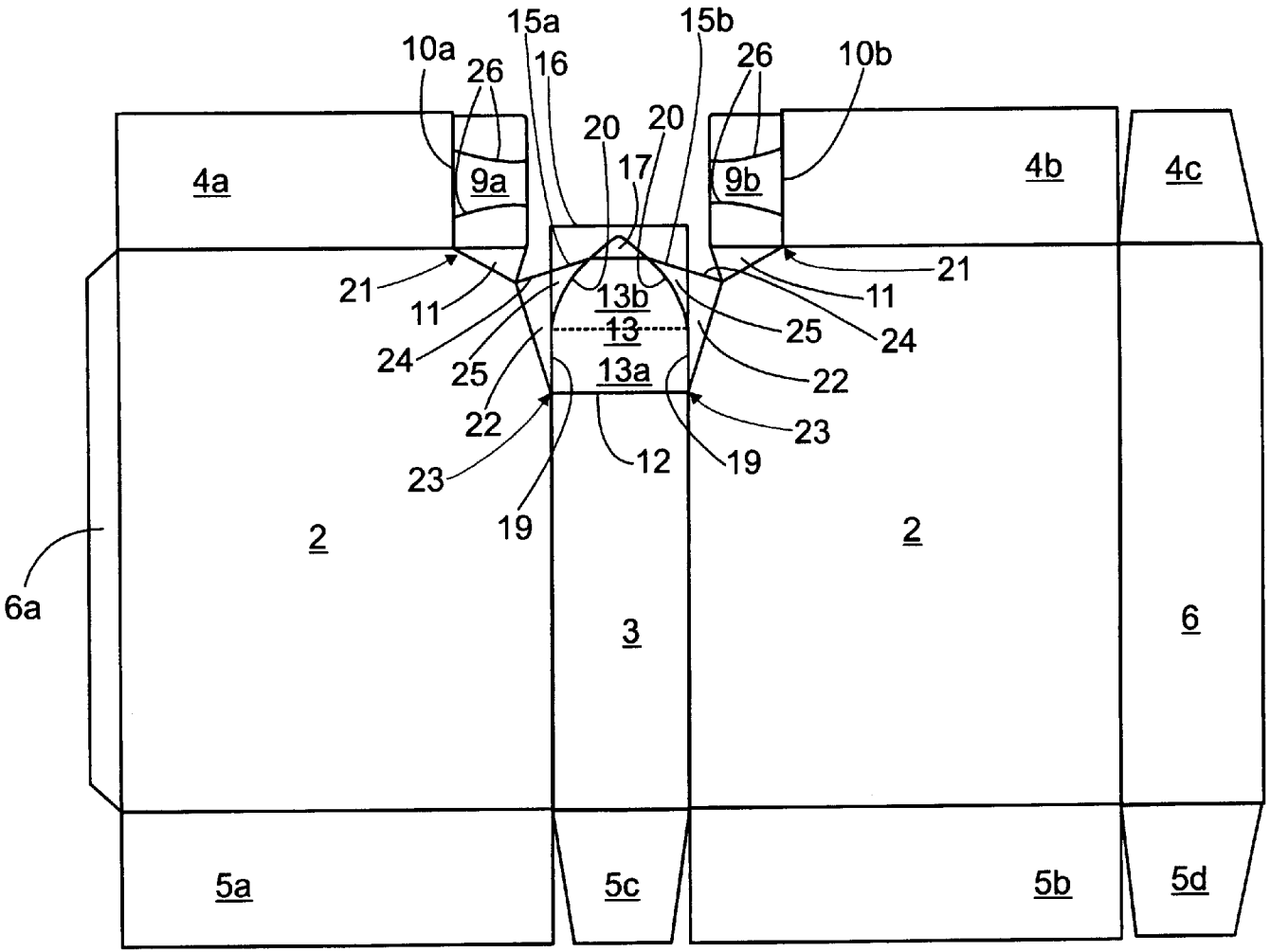
FIG. 5 shows a blank piece of laminar material, such as cardboard, for making the package of FIGS. 1–4, according to the present invention.
Figure 6:
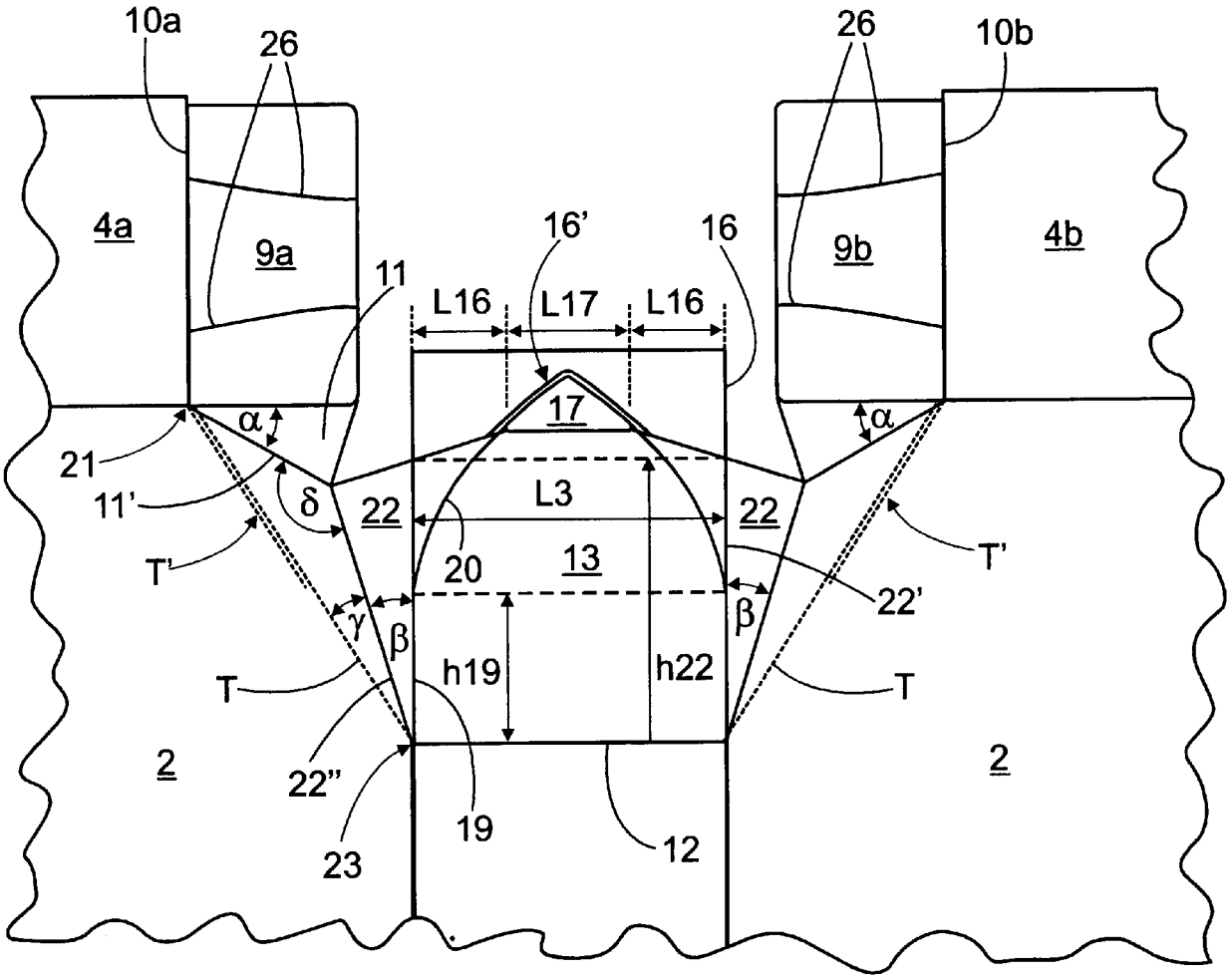
FIG. 6 shows an enlarged partial view of the blank piece of material of FIG. 5, showing in more detail the zone of the blank piece corresponding to the spout of the inventive package.

Now referring in detail to the drawings it may be seen from FIGS. 1 and 2 a package for pourable products, according to the invention, which is preferably defined by a quadrangular or cubic box indicated by general reference 1, having side walls 2, a front wall 3, an upper or top wall 4, a bottom or lower wall 5, and a rear wall 6. The package has a truncated vertex or corner 7 with a conformed tamper-evident and/or pilfer-proof retractile pouring spout 8 which is defined or delimited by side walls 2, front 3 and upper 4 walls. Said spout is integral with a blank, preferably only one piece of laminar material, of cardboard for example, as it is illustrated in FIGS. 5 and 6, from which the inventive package is formed. As it will be further described, spout 8 can be moved between a closing position and an opening position.

Corner 7 includes an upper inclined portion 9 downwardly and inwardly extending from a transverse folding line 10 in the upper wall towards the front wall, with inclined portion 9 being fixed to side walls 2 by first fold portions 11 formed as a part of the side walls. Spout 8 is most preferably defined in the front wall by a deploying snapping movable portion 3*a* upwardly extending from a transverse folding line 12 in front wall 3, towards the upper inclined portion and overlapping the upper inclined portion. The snapping portion comprises a central portion 13 and second fold portions 14, the latter also forming part of the side walls, and the snapping portion is connected to the side walls by resilient driving means for providing the snapping portion with a snapping effect in the movement between the close position and the open position. By means of the snapping or resilient driving means the snapping portion snap-moves between a close position wherein the snapping portion is resting against upper inclined portion 9 and closing the package, and an open position wherein the snapping portion is spaced apart from the upper inclined portion in a manner to form a pouring spout.

At least an upper edge 15 of the snapping portion is detachably fixed or adhered to inclined portion 9 and, preferably, snapping portion includes a wing 16 partially joined to edge 15 and adhered to portion 9 by any appropriate adhesive, hot melt, etc. Alternatively, wing 16 may not be provided or, if provided, may extend even beyond folding line 10, indicated by 10*a* and 10*b*. Wing 16 even may be provided far below line 10 and below the most extended or projected end of snapping portion, at any level that may be considered appropriate or desired according to the type of package and application.

For the purpose of this application, the term "folding line" should be understood as any mark, indicia, weaken line, stamped line or any other line for facilitating the folding of any portion of the laminar material to conform the package. When indicated, the folding lines may be duly weakened or pre-cut or partially cut to permit the easy tearing of the desired part to detach that part or portion from the remaining part of the box.

For permitting the deployment of snapping portion for forming the spout, wing 16 is joined to the snapping portion through tearing lines 15*a* and 15*b* which are coincident with side segments of upper edge 15 defined at both sides of a cut 16'. Snapping portion has a most upwardly projecting portion defining a pulling tongue 17 encircled by cut 16' and, hence, by wing 16, whereby tongue 17 may be taken by the consumer's fingers and, upon pulling from the tongue 17, lines 15*a* and 15*b* will broke and wing 16 will remain adhered to portion 9. Snapping portion 3*a* will thus be deployed to form spout 8 and the outwardly movement of snapping portion will be under a snapping resilient effect thank to several curved and triangular portions as will be described later.

Figure 3:
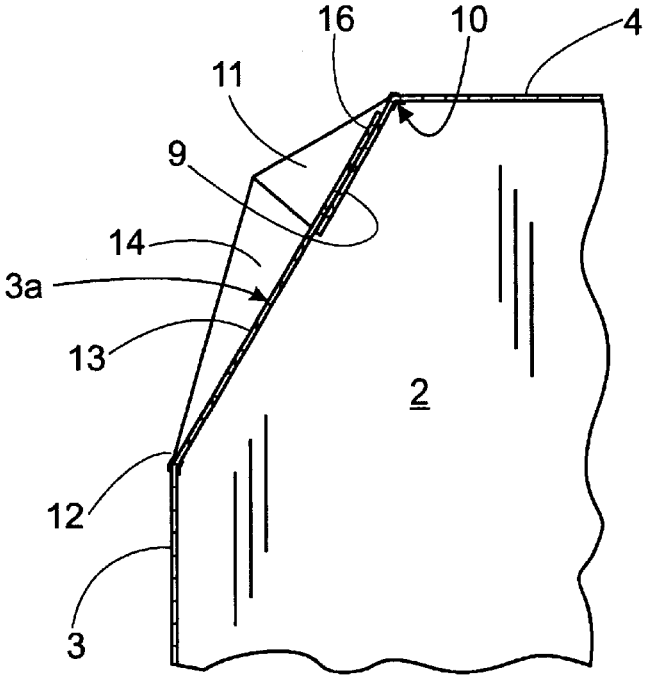
FIG. 3 shows an elevation cross-section view of the inventive package, taken along line III—III of FIG. 1, showing the snapping portion adhered to the upper inclined portion in a closing position.
Figure 4:
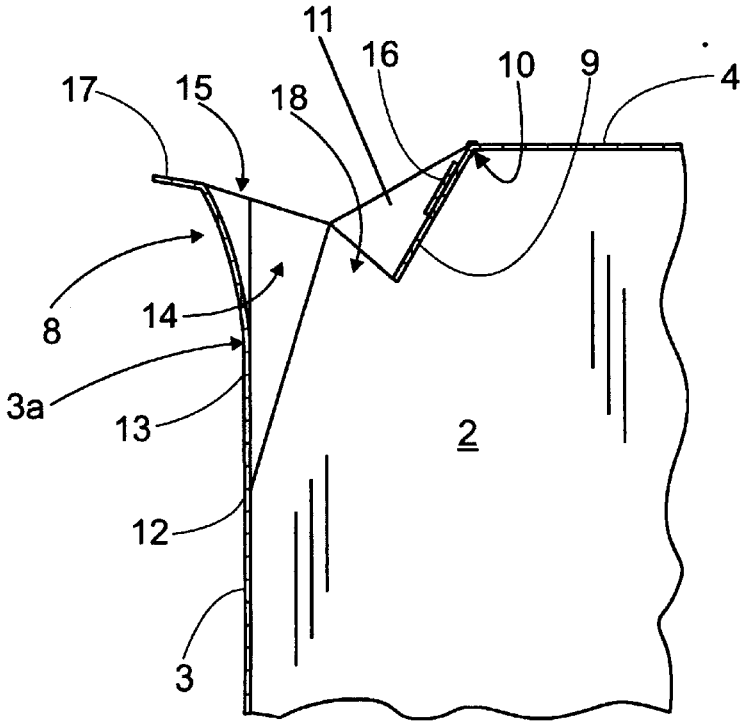
FIG. 4 shows an elevation cross-section view of the package of the invention, taken along line IV—IV of FIG. 2, showing the snapping portion deployed from the upper inclined portion in an open position, showing the pouring opening and the damming wall formed by the inclined portion to control the pouring of the product.

As it can be better seen from FIGS. 3 and 4, in cross-section, a pouring opening 18 is defined between the side, upper and front walls, as well as by upper inclined portion 9 and snapping movable portion 3*a*. In the close position, snapping portion 3*a* rests against upper inclined portion 9 and closes opening 18, with the upper inclined portion and the snapping portion preferably inclined along the same angle.

In the open position, snapping portion 3*a* is spaced apart from the upper inclined portion in a manner that the pouring opening forms a pouring spout, with the snapping portion defining an outwardly extended curve. In addition, when the snapping portion is in the open position, the upper inclined portion forms a partial damming or retention wall, see FIG. 4, through the pouring opening, whereby controlling the flow of the pourable or flowable products passing through opening 18.

As it will be described in more detail in connection to FIGS. 5 and 6, the inventive package is made from a single piece or blank of laminar material. The blank includes upper panels 4*a*, 4*b* and 4*c* for forming upper wall 4 and lower or bottom panels 5*a*, 5*b*, 5*c* and 5*d* for forming bottom wall 5. A panel 6*a* is also designed to be adhered to rear wall 6. A pair of leaves 9*a* and 9*b* are also provided as part of panels 4*a* and 4*b*, respectively, to form inclined portion 9. Portion 9 is formed by overlapping leaves 9*a* and 9*b* and each leaf includes folding lines 26 for facilitating a downward folding of the leaves during a manufacturing process of the package.

Central portion 13 of snapping portion 3*a* comprises a lower portion 13*a* and an upper portion 13*b* which portions are illustrated separated by a phantom or broken line for clarity purposes. Lower portion 13*b* is defined by side straight folding lines 19 and upper portion 13*a* is defined by side curved folding lines 20 forming an ogival profile continuing into pulling tongue 17.

FIGS. 5 and 6 show first fold portions 11 are part of side walls 2 and are formed as upper triangular portions having a smallest-angle vertex 21 enclosing an angle and coinciding with line 10 in upper wall 4. Angle is about 30° and, when the blank piece is folded for making the package, provides inclined portion 9 with an about 60° inclination relative to the upper wall. However, the value of such angles may vary depending of several factors such as the box size, materials employed in the box and the process of manufacturing the package.

Preferably, the resilient or snapping driving means are comprised by the combination of curved lines 20, ogival design, and second fold portions 14. Thank to this means, snapping portion 3*a* moves with abrupt closing and opening movements, particularly convenient to firmly keep the spout formed in the open position and for keeping portion 3*a* firmly closed against portion 9 when it is in the closed position. Each fold portion 14 is defined as a part of the corresponding side wall 2 and is shaped as a lower triangular portion 22 having a smallest-angle vertex 23 enclosing an angle and coinciding with transverse folding line 12 for permitting the pivoting movement of portion 3*a*. The lower triangular portion has a smallest side defined by a segment 24 of upper edge 15 of the snapping portion, and an outer side 22" defining a hinge side forming a hinge between the corresponding side wall and the snapping portion. A remaining longest side 22' of triangle portion 22 extends from vertex 23 to edge 15 and partially coincides with straight folding lines 19 at each side of central portion 13.

The resilient driving means also comprises, at each side of the central portion of the snapping portion, a triangular curved portion 25 defined by one of said curved lines 20 defining the ogival profile, by the longest side of second fold portion or triangular portion 22 and by part of the upper edge, preferably by tearing lines 15*a* and 15*b*, if wing 16 is provided and these lines are included for the detaching thereof. Curved triangular portion 25 actuates as an elastic driving portion to produce, or at least cooperate in, the snapping or abrupt movement of snapping portion 3*a* when pulling from tongue 17 for opening, or when downwardly pushing the same, for closing.

The smallest angle of triangular portion 22 is from about 15° to about 18°, therefore, when the blank piece is folded, an inclination of about 30° is defined between front wall 3 and central portion 13, portion 25 and tongue 17, as well as wing 16 if provided. Thus, at least part of upper portion 13*b* and portion 25 extends over inclined portion 9, thus closing opening 18 (FIG. 3). Again, it is remarked that the above mentioned angles may vary depending on box sizes, materials and processes employed in the package.

As it may be understood by any person skilled in the art, the folding lines in the snapping portion mostly define hinge or pivoting lines for the moving of portion 3*a*. FIG. 6 shows the main sizes and proportions of angles, lengths, widths, etc. of the blank piece for forming the package and spout of the invention by means of only one piece of material. For example, width L17 of pulling tongue 17 and width L16 associated to curvilinear lines 20, for inducing the opening and closing movements of spout 8, have a L16 to L17 ratio of 2:3. In addition, the width L3 of front wall 3, in this embodiment, is approximately equal to height h22 measured between line 12 and the joint between side 22' and 15*a* or 15*b*. The height h19 of line 19 is about the half h22. The variation of angles in the folding of fold portion 22 is preferably between 5° and 30°. In this embodiment, the values are =30°; =15° and angle=135°. All these dimensions, however, are exemplary and not restrictive or limitative at all.

Broken line T is the line corresponding to line 22' once portion 22 is folded and broken line T' is the trace corresponding to portion 9 once folded. Line T is obtained based on angle. In addition, =. Thus, leaves 9*a* and 9*b*, when overlapped and folded, define portion 9 which in turn forms a resting surface for snapping portion 3*a*, with the small gap or spacing between two lines T and T' being the spacing corresponding to the thickness of the laminar material employed in the manufacturing of the box.

As it was already indicated above, all the dimensions, angles, as well as the lengths of the folding lines, depend on the size and kind or type of package, the material of the blank piece, and the manufacturing process. For example, folding lines 26 may be or not provided in leaves 9*a* and 9*b*. Lines 26 may be useful in a particular process where the machine must push leaves 9*a* and 9*b* downwardly to fold the same around lines 10*a* and 10*b*. This will depend on the size of leaves and/or the blank thickness. If leaves are resistant, lines 26 will help the machine pushing the leaves, forming a downward arc thereon and causing the same to yield upon the downward force and fold along angle.

While preferred embodiments of the present invention have been illustrated and described, it will be obvious to those skilled in the art that various changes and modifications may be made therein without departing from the scope of the invention as defined in the appended claims.

I claim:

1. A package for pourable products, with tamper-evident retractile pouring spout, the package comprising a box with a corner thereof having a pouring opening defined between an upper wall, a front wall and side walls, the corner including an upper inclined portion downwardly extending from the upper wall towards the front wall, and a snapping movable portion upwardly extending from the front wall and overlapping the upper inclined portion, the snapping portion snap-moving between a close position wherein the snapping portion is resting against the upper inclined portion and closing the opening, and an open position wherein the snapping portion is spaced apart from the upper inclined portion in a manner that the pouring opening forms a pouring spout.

2. The package of claim 1, wherein, the upper inclined portion downwardly extends from a transverse folding line in the upper wall towards the front wall, the snapping movable portion extends from a folding line in the front wall towards the upper inclined portion, the pouring opening being further defined between the upper inclined portion and the snapping movable portion, and the snapping portion is connected to the side walls by resilient driving means for providing the snapping portion with a snapping effect in the movement between the close position and the open position.

3. The package of claim 2, wherein the upper inclined portion is inwardly extending and fixed to the side walls by first fold portions of the side walls.

4. The package of claim 2, wherein the snapping portion includes an upper edge that is detachably fixed to the upper inclined portion.

5. The package of claim 2, wherein the upper inclined portion and the snapping portion are inclined the same angle when the snapping portion is in the close position.

6. The package of claim 5, wherein the snapping portion defines an outwardly extended curve when the snapping portion is in the open position, whereby forming the pouring spout.

7. The package of claim 4, wherein the upper edge of the snapping portion includes a pulling tongue upwardly extending from the snapping portion.

8. The package of claim 7, wherein the pulling tongue is encircled by a wing extending from the upper edge of the snapping portion, the wing being joined to the upper edge by a tearing line and being spaced apart from the pulling tongue by a cut, the wing being adhered at least to the upper inclined portion in such a manner that a consumer may pull from the pulling tongue to split the snapping portion from the wing that remains adhered to the upper inclined portion thus forming a tamper-evident spout.

9. The package of claim 8, wherein the snapping portion comprises a central portion having a lower portion defined by side straight folding lines and an upper portion defined by curved folding lines forming an ogival profile continuing into the pulling tongue.

10. The package of claim 9, wherein the resilient driving means comprises, at each side of the central portion of the snapping portion, a second fold portion defined in the side wall and a triangular curved portion defined by one of said curved lines defining the ogival profile, by the second fold portion and by part of the upper edge.

11. The package of claim 10, wherein each second fold portion is defined by an lower triangular portion in the side wall, the lower triangular portion having a smallest-angle vertex coincident with the folding line of the snapping portion in the front wall, the lower triangular portion having a smallest side defined by a segment of the upper edge of the snapping portion, the lower triangular portion having a longest side coincident partially with the straight folding lines of the central portion and partially with a side of the triangular curved portion in the snapping portion.

12. The package of claim 3, wherein the first fold portions comprises an upper triangular portion defined in the side wall at each side of the upper wall, each upper triangular portion having a smallest-angle vertex coincident with the transverse folding line of the upper inclined portion in the upper wall of the package, said smallest-angle vertex defining an angle of about 30°, with the inclined upper portion being inclined about 60° relative to the upper wall.

13. The package of claim 11, wherein the smallest-angle vertex of the lower triangular portion defines an angle of about 15°, with the snapping portion being inclined about 30° relative to the front wall.

14. The package of claim 11, wherein the lower triangular portion further includes an outer hinge side forming a hinge between the corresponding side wall and the snapping portion.

15. The package of claim 2, wherein the upper inclined portion is formed by a pair of overlapping leaves, each leaf being part of corresponding upper overlapping panels that form the upper wall of the package.

16. The package of claim 15, wherein each leaf includes folding lines for facilitating a downward folding of the leaves during a manufacturing process of the package.

17. The package of claim 2, wherein the upper inclined portion forms a partial damming wall in the pouring opening when the snapping portion is in the open position, whereby controlling the flow of the pourable products passing through the opening.

18. The package of claim 2, wherein the entire package is made of only one integral blank piece of laminar material.

19. The package of claim 18, wherein the laminar material is cardboard.

20. A package, with integral tamper-evident retractile pouring spout and pouring control, for containing and dispensing pourable products, the package comprising a box made from an integral cardboard piece, the box having at least one corner formed by side walls, an upper wall and a front wall, the corner including:

an upper inclined portion downwardly extending from a transverse folding line in the upper wall towards the front wall, a snapping movable portion in the front wall, the snapping portion upwardly extending from a folding line in the front wall towards the upper inclined portion, and a pouring opening defined between the upper inclined portion and the snapping movable portion, wherein the snapping portion is movable between a close position wherein the snapping portion is resting against the upper inclined portion and closing the opening, and an open position wherein the snapping portion is spaced apart from the upper inclined portion in a manner that the pouring opening forms a pouring spout, the snapping portion being connected to the side walls by resilient driving means for providing the snapping portion with a snapping effect in the movement between the close position and the open position.

* * * * *